United States Patent [19]

Huang

[11] Patent Number: 5,020,165

[45] Date of Patent: Jun. 4, 1991

[54] TOILET SEAT RAISING APPARATUS

[76] Inventor: Clark Huang, No. 4, Lane 60, Shou Fa Rd., Tao Yuan City, Taiwan

[21] Appl. No.: 590,216

[22] Filed: Sep. 28, 1990

[51] Int. Cl.[5] ..... A47K 13/10

[52] U.S. Cl. ..... 4/251; 4/236; 4/240; 4/241

[58] Field of Search ..... 4/251, 236, 240, 661, 4/241, 248

[56] References Cited

U.S. PATENT DOCUMENTS

| | | | |
|---|---|---|---|
| 3,284,810 | 11/1966 | Stokes | 4/251 |
| 4,291,422 | 9/1981 | Shoemaker et al. | 4/251 |
| 4,433,442 | 2/1984 | Liou | 4/251 |
| 4,914,757 | 4/1990 | Johnson | 4/251 |

FOREIGN PATENT DOCUMENTS

| | | | |
|---|---|---|---|
| 2187769 | 9/1987 | United Kingdom | 4/251 |

*Primary Examiner*—Henry K. Artis

[57] ABSTRACT

An apparatus for raising a toilet seat comprising a bucket which revolves around a bar by receiving water imparted from a flush pipe by an inlet pipe, and then drives a weight mechanism by pushing a pin on a second tube with a first L-shape pin on a first tube, both tubes of which rotate on the bar and one of which connects with the bucket by a pair of rods, the weight mechanism abutting a pin on the bar by a second L-shape pin which rotates and raises the toilet seat by turning the bar which is fixed to the seat.

5 Claims, 4 Drawing Sheets

TOILET SEAT RAISING APPARATUS

BACKGROUND OF THE INVENTION

In the conventional lavatory, the user has to bend to raise the toilet seat with a hand after stooling. If the seat is not raised after someone urinates, it may be dirtied to the consternation of the next user.

In the prior art, various apparatus have been disclosed for raising the toilet seat, such as U.S. Pat. No. 2,219 ,044 which discloses and apparatus including an electric motor and gears for raising the toilet seat.

U.S. Pat. No. 1,863,682 discloses an apparatus providing a complex gear means for raising the toilet seat.

However, it has been found that the apparatus of those described either comprises complex mechanisms or utilizes an electrical motor to raise a toilet seat.

The present invention relates to an apparatus for raising the toilet seat actuated by flushing the toilet.

SUMMARY OF THE INVENTION

The present invention comprises a driving means, a weighting means and a bar, and utilizes the moment of the driving means and weighting means caused by the receiving water to rotate the bar.

It is an object of this invention to provide a simple structured apparatus for automatically raising the toilet seat.

A further object of this invention is to provide an apparatus for raising the toilet seat actuated by flushing the toilet pan after stooling.

it is the purpose of this present invention, therefore, to mitigate and/or obviate the above-mentioned drawback in the manner set forth in the detailed description of the preferred embodiment.

DETAILED DESCRIPTION OF THE PREFERRED EMBODIMENT

Figure 1:
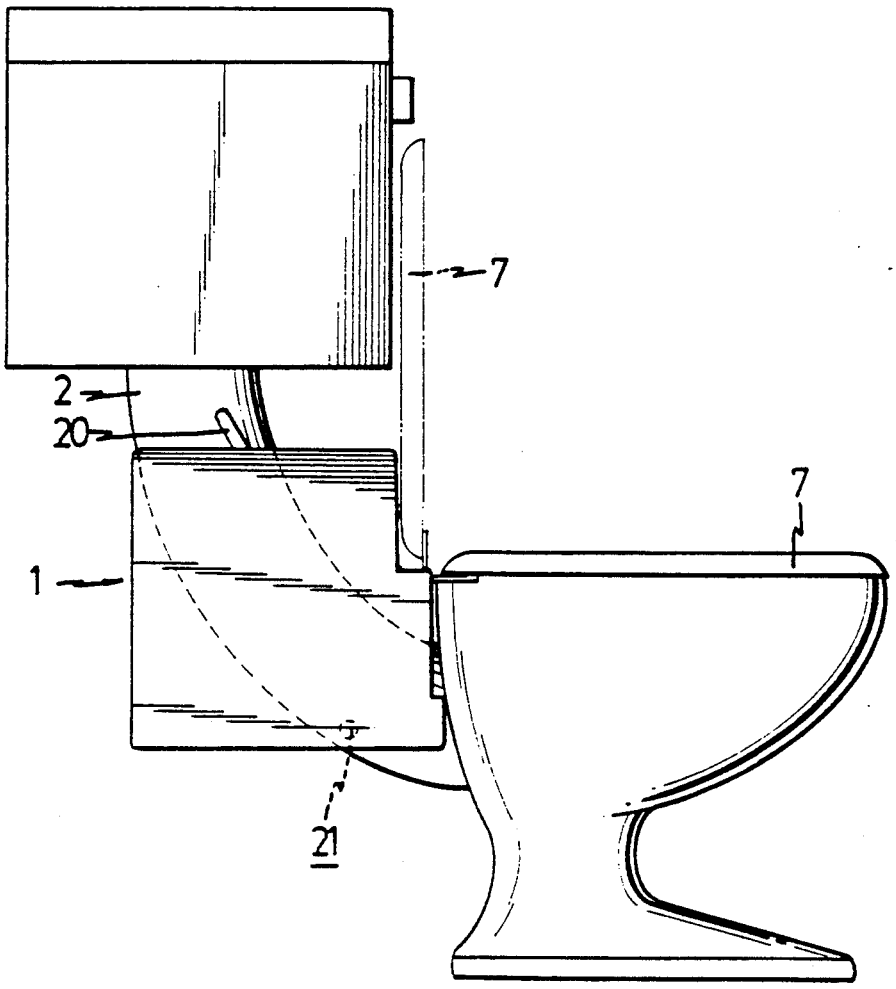
FIG. 1 is a schematic illustrating the apparatus in accordance with the present invention in which the apparatus being shown to mount on a toilet pan.

Referring to FIG. 1, the apparatus 1 of the present invention is mounted behind the toilet pan and below the water tank of a conventional toilet.

Figure 2:
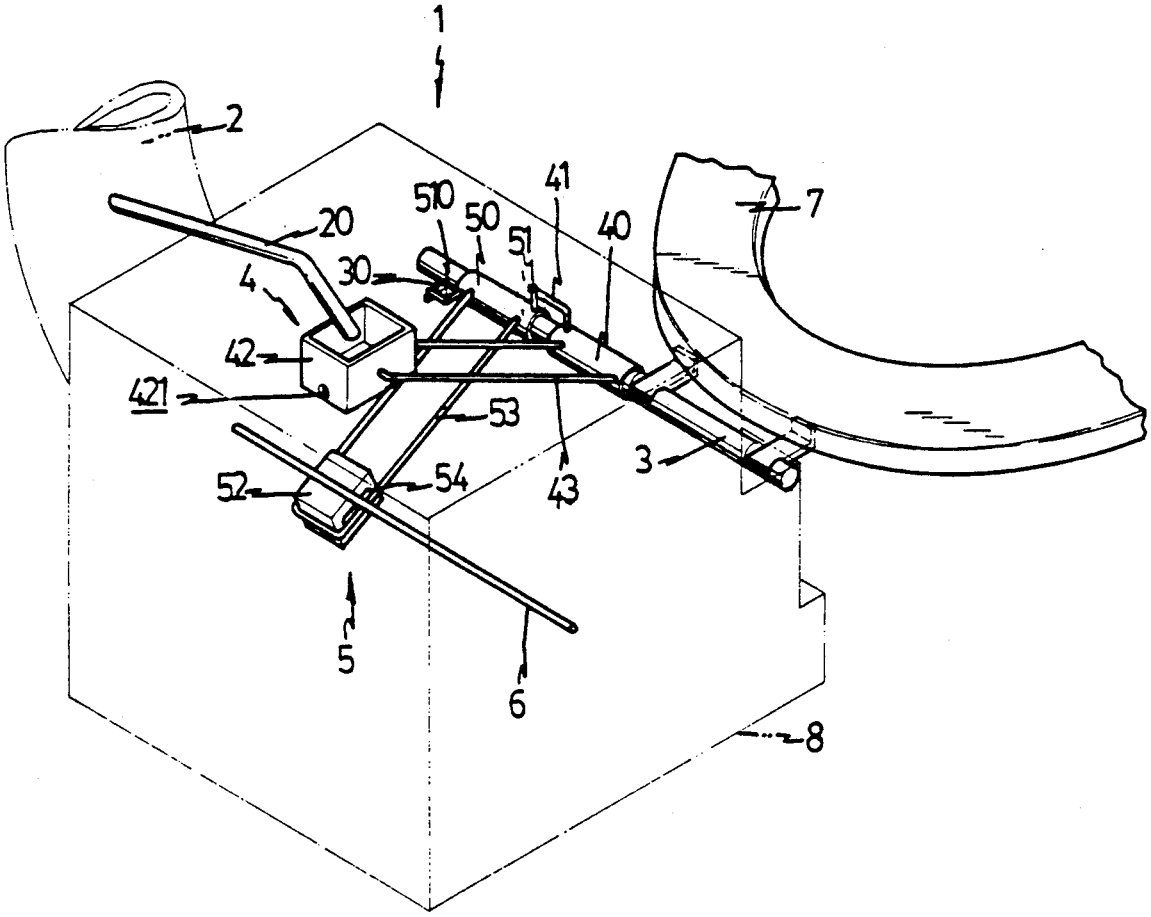
FIG. 2 is a perspective view showing the structure of a toilet seat raising apparatus in accordance with the present invention.

Referring to FIG. 2, the apparatus 1, in accordance with the invention, substantially comprises a bar 3, a driving means 4, and a weighting means 5.

The bar 3, which can be rotatably supported in the housing 8 in a known manner, has a pin 30 radially extending therefrom. The bar 3 is rigidly connected to a toilet seat 7 so that, upon actuation, the bar 3 can be rotated to raise the toilet seat 7.

The driving means 4 comprises a bucket 42, a first tube 40 rotatably mounting on the bar 3, and a first L-shape pin 41 fixed axially outwardly on the first tube 40. The bucket 42 is linked to the first tube 40 by a pair of rods 43. The bucket 42 may be a box-like container with an open top, rotatably supported by the rods 43, further, the bucket when empty is raised about 30 degrees from the horizontal.

The weighting means 5 comprises a block weight 52 and a second tube 50, said tube rotatably mounted on the bar 3 and positioned adjacent to the first tube 40. The second tube 50 has a first radial pin 51 on a side adjacent to the L-shaped pin 41 and a second L-shaped pin 510 fixed axially outwardly on another side cooperating with the second radial pin 30 of the bar 3. The block weight 52 is provided with slots 54 on its opposing sides to engage with a U-shaped rod 53 which is connected fixedly to the second tube 50. The U-shaped rod 53 can be enlarged in width slightly so as to adjust the position of the block weight 52 along the length of rod 53.

The position of the block weight 52 can be adjusted so that the moment exerted by the driving means 4 and the weighting means 5 on the bar 3 is slightly less than that of the toilet seat 7.

In operation, when the paddle of the water tank (not shown) is pressed to flush the toilet pan, the bucket 42 receives a certain amount of water inparted from the flush pipe 2 by the inlet pipe 20 and then revolves around the bar 3. The revolving bucket 42, fixed to the first tube 40, produces a moment around the bar 3. The first L-shaped pin 41 on the tube 40 rotates with the first tube 40 and contracts the first radial pin 51 on the second tube 50.

When the first radial pin 51 is forced by the first L-shaped pin 41, it is caused to rotate with the first tube 40 by the moment of the bucket 42, and the second tube 50 simultaneously is rotated around the bar 3 with the first tube 40.

The second radial pin 30 on the bar 3 is located adjacent to the second tube 50 and abutted by the second L-shaped pin 510. While the weighting means 5 rotates around the bar 3, the second L-shaped pin 510 actuates the bar 3 to rotate and to thereby raise the seat 7.

Figure 3:
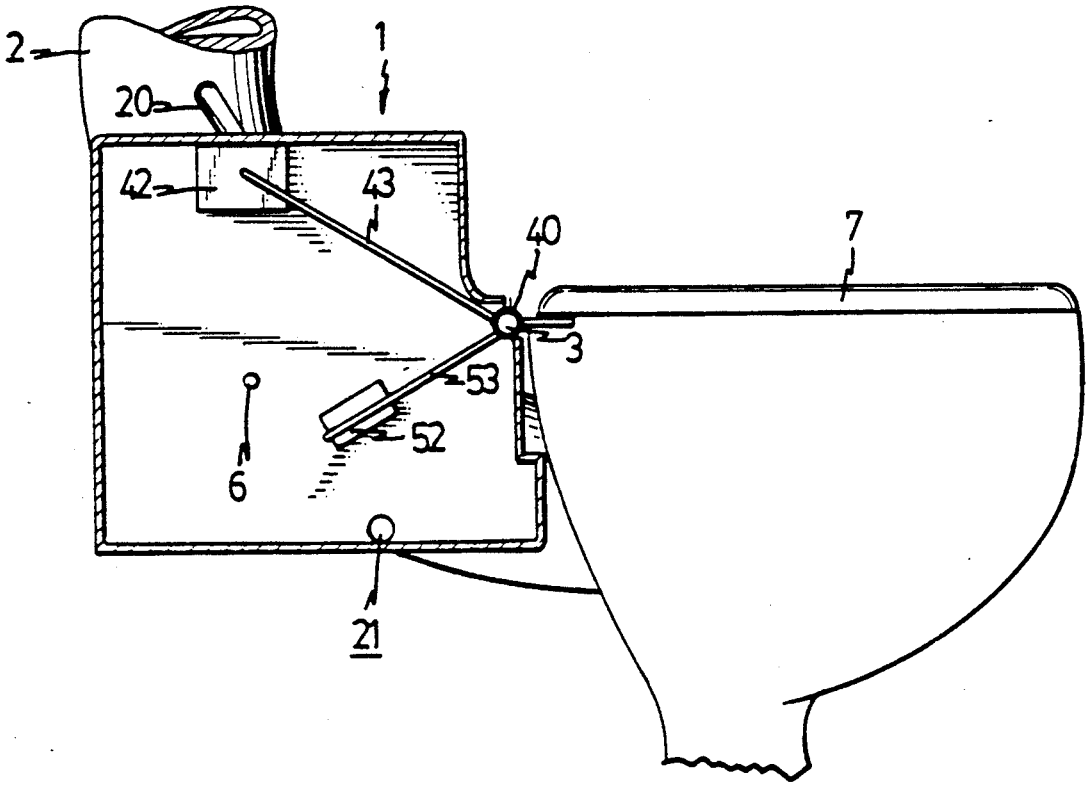
FIG. 3 is a side elevational view showing the apparatus of FIG. 1 in a pre-operating configuration and the toilet seat in a horizontal position.
Figure 4:
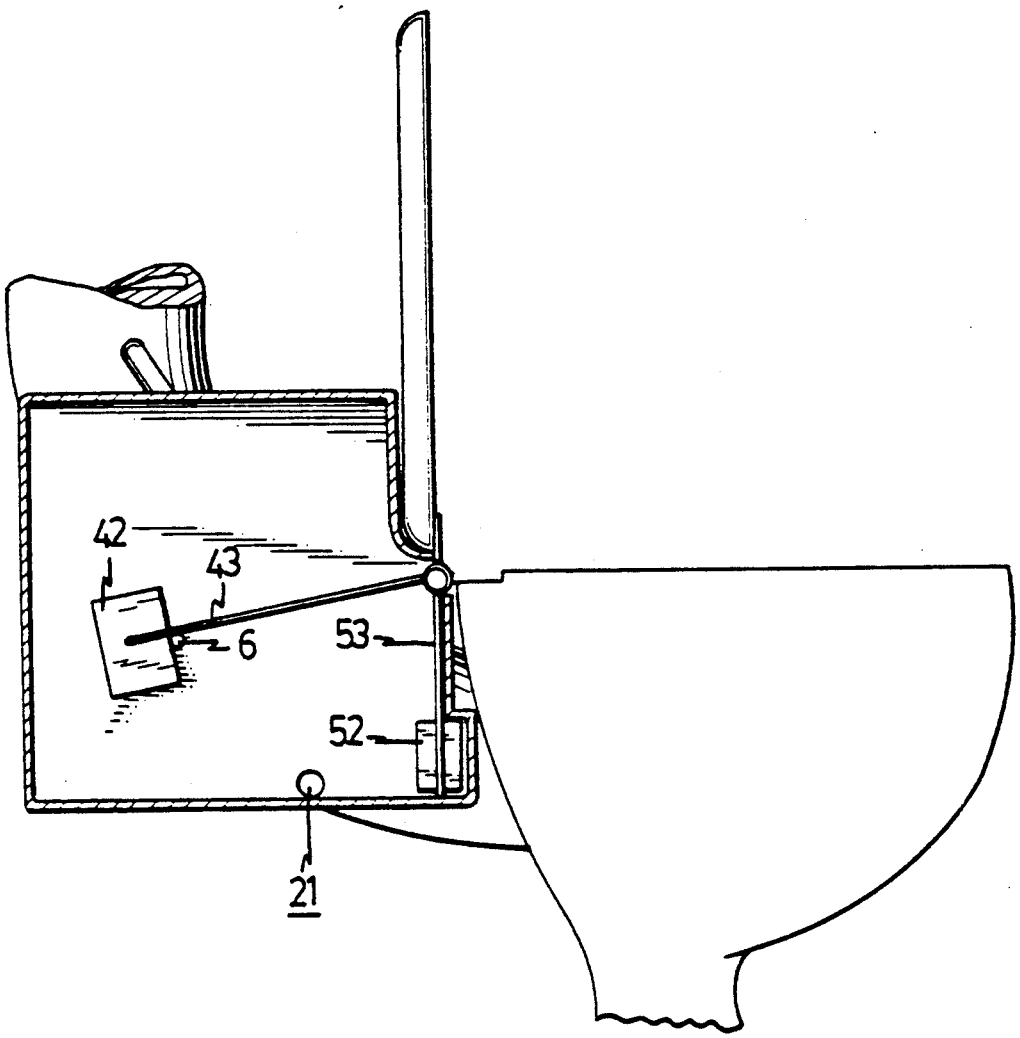
FIG. 4 is a side elevational view showing the apparatus of FIG. 1 in a after-operating configuration and the toilet seat in a vertical position.

Referring now to FIGS. 3 and 4, a horizontal rod 6 extends within the housing below the bucket 42. When the bucket 42 has received a certain amount of water, it causes the driving means to rotate. When the driving means is rotated sufficiently to contact with the rod 6, the rod 6 stops and tilts the bucket 42, pouring out the water contained therein. The water may then flow through a drainage hole 21 provided in the bottom of the housing 8 and may lead back to the flush pipe 2.

After contact between the bucket and the rod 6, the rotation of the weighting means 5 continues due to the rotational inertia of the weighting means. And while the weighting means hits the front wall of the housing, the rotating toilet seat 7 continues to rotate because of its moment of inertia until the toilet seat 7 is raised to abut with the water tank. The seat is then kept in this position, see FIG. 4, until the next user lowers it.

Further, the bucket 42 may be provided with a hole 421 on a lower portion of its wall. The diameter of the hole being smaller than that of hte inlet pipe, the flow rate of the water through the hole is always less than that of the inlet pipe 20. While the present invention has been explained in relation to its preferred embodiment, it is to be understood that various modification thereof will be apparent to those skilled in the art upon reading this specification. Therefore, it is to be understood that the invention disclosed herein is intended to cover all such modifications as shall fall within the scope of the appended claims.

I claim:

1. An apparatus for raising a toilet seat comprising:

a housing and a bar rotatably supported on said housing, said bar having a first radial pin and being fixedly connected to a rear side of the toilet seat for raising the toilet seat;

a driving means comprising a first tube rotatably mounted on said bar and a bucket, linked to said first tube by a pair of rods, situated to receive water from an inlet pipe, said first tube having a first L-shaped pin fixedly provided thereon, said bucket being capable of actuating said first tube to rotate about said bar due to a weight of the recieved water contained within said bucket;

a weighting means comprising a second tube, rotatably mounted on said bar and adjacent to said first tube, and a block weight linked to said second tube by a U-shaped rod, said second tube having a second L-shaped pin fixedly provided thereon and adjacent to said radial pin of said bar, and a second radial pin fixedly provided thereon and adjacent to said first L-shaped pin of said first tube, said second L-shaped pin constantly abutting said first radial pin of said bar due to the weight of said block weight and thereby said block weight applies a moment intended to raise the toilet seat on said bar, said first L-shaped pin of said first tube being in contact with and abutting said second radial pin when said bucket actuates said first tube to rotate about said bar, said bucket containing a predetermined quantity of received water therein and said block weight mutually applying a resulting moment on said bar capable of raising the toilet seat.

2. The apparatus as claimed in claim 1, further comprising means for emptying the water contained within said bucket after the toilet seats is raised to a substantially vertical position.

3. The apparatus as claimed in claim 2, wherein said means for emptying comprises a horizontal rod extending within said housing for tilting said bucket to pour out the water contained therewithin.

4. The apparatus described as claim 2, wherein said means for emptying comprises an orifice provided on a lower portion of a wall of said bucket, said orifice having a diameter substantially smaller that the diameter of the inlet pipe.

5. The apparatus described as claim 1, wherein the block weight has a slot on each of two opposite sides thereof to engage with the two arms of said U-shaped rod so that said block weight is slidably adjustable along said rod to produce a variable moment on said bar.

* * * * *